United States Patent [19]

Nojiri et al.

[11] Patent Number: 4,514,146

[45] Date of Patent: Apr. 30, 1985

[54] PROPELLER FOR SHIP

[75] Inventors: Takeo Nojiri, Kamakura; Yasuo Irie, Yokohama, both of Japan

[73] Assignee: Mitsui Engineering & Shipbuilding Co., Ltd., Tokyo, Japan

[21] Appl. No.: 436,988

[22] Filed: Oct. 22, 1982

[51] Int. Cl.[3] ..... B63H 1/20

[52] U.S. Cl. ..... 416/200 R; 416/175; 416/238

[58] Field of Search ..... 416/238, 203, 175, 200 RA; 440/79, 81

[56] References Cited

U.S. PATENT DOCUMENTS

| | | | |
|---|---|---|---|
| 118,325 | 8/1871 | Zahn | 416/198 |
| 1,012,441 | 12/1911 | Reid | 416/238 |
| 1,715,071 | 5/1929 | Martens et al. | 416/238 |
| 2,978,233 | 4/1961 | Davey | 416/175 |
| 4,306,839 | 12/1981 | Pien | 416/238 |

FOREIGN PATENT DOCUMENTS

| | | | |
|---|---|---|---|
| 2524555 | 12/1975 | Fed. Rep. of Germany | 416/203 |
| 361316 | 1/1973 | U.S.S.R. | 416/175 R |

*Primary Examiner*—Stephen Marcus
*Assistant Examiner*—Renee S. Kidorf
*Attorney, Agent, or Firm*—Charles E. Pfund

[57] ABSTRACT

In a propeller for use in a ship of the type comprising 4 or more even number blades, at least one of two adjacent blades is inclined forwardly or rearwardly or one inclined forwardly and the other rearwardly so as to make different the rake angles of the two blades. The pitch angle of the rearwardly inclined blade is made larger than that of the forwardly inclined blade. With this construction the mutual interference between adjacent blades is efficiently utilized to prevent decrease in the efficiency even when operating conditions and the diameter of the propeller vary.

6 Claims, 9 Drawing Figures

PROPELLER FOR SHIP

BACKGROUND OF THE INVENTION

This invention relates to a propeller for use in ships.

Usually the maximum diameter of a propeller for use in ships is designed to produce a maximum propelling efficiency at its designed operating point. However, it is generally obliged to make smaller the diameter than the optimum diameter due to the relation between the propeller and the draught line as well as the limitation imposed by vibrations. For this reason, the propellers are used at a considerably inefficient state from the viewpoint of their best efficiencies. To improve the propelling efficiency, it has been proposed the so-called tandem type propeller in which two propellers are coaxially mounted on the same propeller shaft. This design, however, not only lengthens the propeller shaft but also requires reinforcing the bearing that supports the propeller shaft. Moreover, due to the spacing between the tail of the ship and a rudder plate it is difficult to substitute the tandem type propeller for an existing propeller.

SUMMARY OF THE INVENTION

Accordingly, it is an object of this invention to provide an improved propeller having the advantage of the tandem type propeller but eliminating the defect thereof.

A specific object of this invention is to provide an improved propeller for use in a ship having an efficiency comparable with that of a propeller having the optimum diameter, even though the diameter is smaller than this value.

According to this invention, there is provided a propeller for use in a ship of the type comprising a plurality of blades, characterized in that at least one of two adjacent blades is inclined forwardly or rearwardly so as to make different the rake angles of the two blades, and that a pitch angle of a rearwardly inclined blade is made larger than that of a forwardly inclined blade.

DESCRIPTION OF THE PREFERRED EMBODIMENTS

Figure 1:
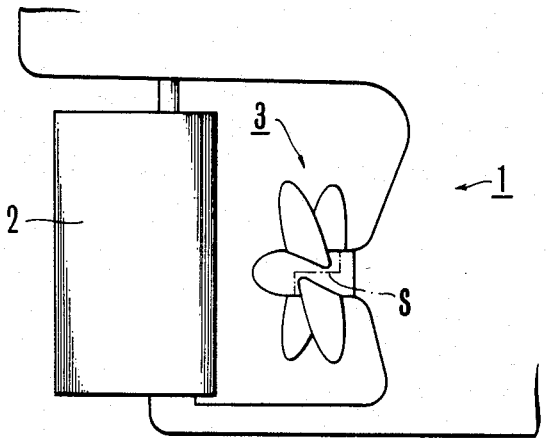
FIG. 1 is a side view showing a first embodiment of the propeller according to this invention together with a rudder plate.

As shown in FIG. 1, a propeller 3 embodying the invention is mounted on a propeller shaft, not shown, and disposed between the tail portion 1 of a ship and its rudder plate 2.

Figure 2A:
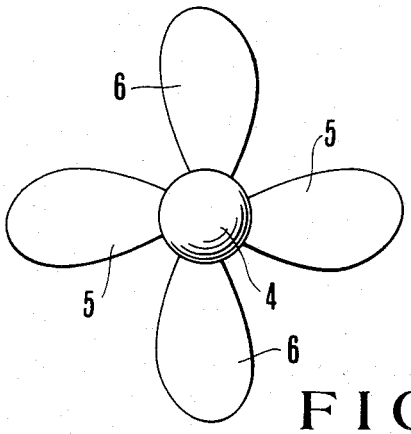
FIG. 2*a* is a front elevation view of the propeller shown in FIG. 1.
Figure 2B:
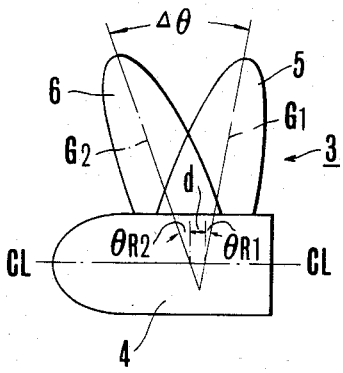
FIG. 2*b* is a side view showing various blades of the propeller developed on the same plane.
Figure 3:
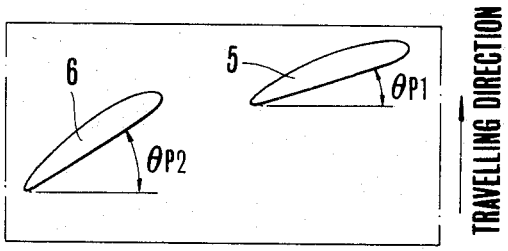
FIG. 3 is a diagrammatic representation showing pitch angles of the blades.

As shown in FIGS. 2*a*, 2*b* and 3, the propeller 3 comprises at least 4, e.g., an even number of blades 5 and 6 having a predetermined diameter and disposed about a boss 4. Of two adjacent blades 5 and 6, the reference line $G_1$ of one blade 5 is inclined forwardly by a rake angle $\theta_{R1}$ with reference to a plane perpendicular to the axis of rotation CL and has a pitch angle $\theta_{P1}$, while the reference line $G_2$ of the other blade 6 is inclined rearwardly by a rake angle $\theta_{R2}$ with respect to the plane perpendicular to the axis of rotation CL such that when its reference line $G_2$ is developed on the same plane as the reference line $G_1$ of the blade 5, the reference line $G_2$ will cross at an angle of $\Delta\theta$ on the opposite side of the axis of rotation CL, that is respective reference lines $G_1$ and $G_2$ contact the peripheral surface of the boss at a spacing of d. Furthermore, the blade 6 has a pitch angle $\theta_{P2}$ larger than that $\theta_{P1}$ of the blade 5.

In this first embodiment, since adjacent blades 5 and 6 secured to the common boss 4 have different rake angles and pitch angles, the rearwardly inclined blade 6 presents in a flow of water accelerated by the forwardly inclined blade 5. For this reason, even when the operating conditions (number of revolutions, flow velocity, etc.) and the diameter of the propeller vary more or less, the characteristics of the forward blade 5 vary in the same as those of the prior art propeller. Since the rearward blade 6 has a larger pitch angle than the forward blade 5, this variation of its characteristics is alleviated by the fact that the blade 6 operates in an accelerated flow whereby the decrease of the propelling efficiency of the rearward blade 6 is smaller than that of the prior art propeller under the conditions described above.

Figure 7:
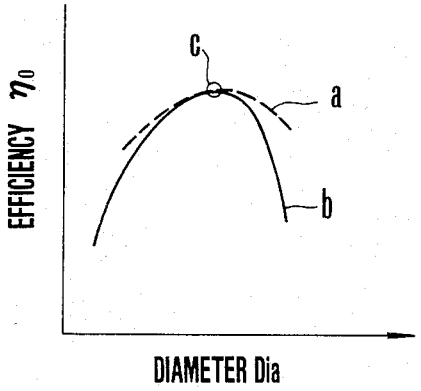
FIG. 7 shows the relation between the propelling efficiency and the diameter of the prior art propeller and the propeller embodying the invention.

FIG. 7 shows the relationship between the diameter Dia and the propelling efficiency $\eta_o$ of the propeller a of the first embodiment and a prior art propeller b. In FIG. 7, c shows the optimum diameter.

Figure 6:
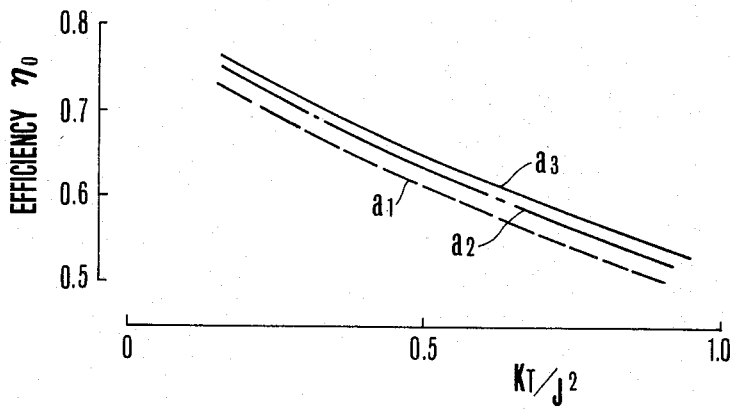
FIG. 6 shows the relationship between the efficiency and the difference between rake angles of the rearward and forward blades by taking the spacing between these blades as parameters.

The result of our investigation shows that the propeller of this invention has a higher efficiency than the conventional propeller when the difference between the rake angles of the blades 5 and 6, that is the angle $\Delta\theta$ shown in FIG. 2*b*, is equal to 10° to 20°, when the spacing d between both blades 5 and 6 is equal to 0.0 to 0.2 $D_p$ ($D_p$ represents the propeller diameter) and when the difference $\Delta(H/D_p)$ between the pitch ratios $(H/D_p)$ of both blades 5 and 6 is equal to 0.1 to 0.3. FIG. 6 shows these characteristics in which curves a1, a2 and a3 respectively represent characteristics when $\Delta\theta=0°$, $\Delta\theta=10°$ and $\Delta\theta=15°$ to 20°, where abscissa represents $KT/J^2=T/(\rho D^2_p V_A^2)$ with $\rho$, $V_A$ and T being density, inlet speed to the propeller and thrust generated in the propeller respectively. These characteristic curves show that, when the relative positions of the forward propeller 5 and the rearward blade 6 are selected properly, the effect due to interference of the forward blade upon the rearward blade 6 can be utilized to prevent decrease in efficiency since the flow is made to be optimum at the surface which determines the ratio of lift to drag.

Figure 4A:
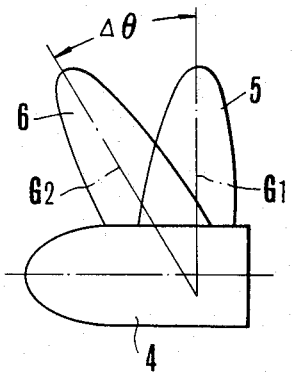
FIGS. 4*a* and 4*b* are side views showing the second and third embodiments of this invention and corresponding to FIG. 2*b* respectively.
Figure 4B:
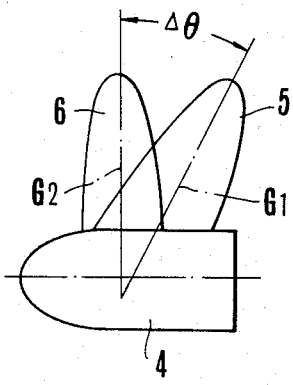
Figure 5:
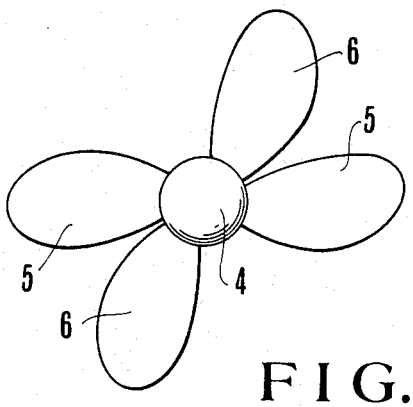
FIG. 5 is a front elevation view showing still another embodiment of this invention.

Although in the embodiment described above, the rake angles of two adjacent blades 5 and 6 are inclined rearwardly and forwardly with respect to a plane perpendicular to the axis CL of rotation, either one of the blades 5 and 6 may be inclined with respect to the plane as shown in FIGS. 4*a* and 4*b* which constitute the second and third embodiments of this invention. To readily manufacture the blades of the first to third embodiments, it is convenient to independently manufacture blades 5 and 6 together with portions of the boss corresponding thereto as shown by dotted lines S shown in FIG. 1. The propeller blades of this invention are not always required to be arranged at an equal pitch in the peripheral direction. For example, pairs of forward and rearward blades 5 and 6 can be arranged at different spacings as shown in FIG. 5. The fact that the cross points of the reference lines $G_1$ and $G_2$ of both blades 5 and 6 with the axis of rotation CL are displaced by d means that the invention is also applicable to a tandem type propeller. For this reason, the spacing d is not essential.

As above described, acording to this invention at least one of the two blades secured to the boss is inclined forwardly or rearwardly to make different their rake angles, and the pitch angle of the forward blade is made smaller than that of the rearward blade so as to positively utilize the mutual interference of the two blades. Consequently, even when the operating condition and the diameter vary, the propelling efficiency does not decrease as in the prior art propeller. Moreover, different from the conventional tandem type propeller, the axial length of the propeller does not increase so that it is not necessary to reinforce the propeller shaft and its bearing. Consequently, the propeller of this invention can be applied to existing ships.

What is claimed is:

1. A propeller for use in a ship comprising a plurality of pairs of blades having axially overlapping roots anchored to a common hub, at least one of two adjacent blades being inclined forwardly or rearwardly so as to make different the rake angles of the two adjacent blades, and the pitch angle of a rearward blade being made larger than that of a forward blade, the difference in said rake angles being at least 10° to locate the effective area of said rear blade in the accelerated flow from said forward blade.

2. The propeller according to claim 1 wherein the difference in the rake angles of two adjacent blades is in a range of 10° to 20°, and the difference in the pitch ratios of the adjacent two blades is in a range of 0.1 to 0.3.

3. The propeller according to claim 1 wherein the number of the blades is an even number of at least 4.

4. The propeller according to claim 1 wherein one of said two adjacent blades is inclined forwardly and the other is inclined rearwardly with respected to a plane perpendicular to an axis of rotation of the propeller.

5. The propeller according to claim 1 wherein a reference line of one of said two adjacent blades is perpendicular to an axis of rotation of said propeller and a reference line of the other blade is inclined forwardly or rearwardly with respect to the reference line of said one blade.

6. The propeller according to claim 1 wherein a plurality of the blades are combined into a plurality of pairs having different spacings.

* * * * *